United States Patent [19]

Muller

[11] Patent Number: 4,541,511

[45] Date of Patent: Sep. 17, 1985

[54] WHEELCHAIR ELEVATOR AND DOCKING SYSTEM

[75] Inventor: George H. Muller, Ann Arbor, Mich.

[73] Assignee: Ford Motor Company, Dearborn, Mich.

[21] Appl. No.: 589,625

[22] Filed: Mar. 15, 1984

[51] Int. Cl.[4] ..... B66B 9/20

[52] U.S. Cl. ..... 187/9 R; 280/242 WC; 280/189; 414/921; 414/540

[58] Field of Search ..... 187/9 R; 280/189 WC, 280/242 WC; 297/D4; 414/921, 540, 541, 542

[56] References Cited

U.S. PATENT DOCUMENTS

| | | | |
|---|---|---|---|
| 3,677,424 | 7/1972 | Anderson | 414/921 X |
| 4,281,958 | 8/1981 | Molski | 414/542 |
| 4,297,069 | 10/1981 | Worthington | 414/921 X |
| 4,306,634 | 12/1981 | Sangster | 187/9 R |
| 4,365,924 | 12/1982 | Brigman et al. | 280/289 WC X |
| 4,376,611 | 3/1983 | Koop | 414/921 X |

*Primary Examiner*—H. Grant Skaggs
*Assistant Examiner*—Nils E. Pedersen
*Attorney, Agent, or Firm*—Clifford L. Sadler; Daniel M. Stock

[57] ABSTRACT

A wheelchair elevator system for installation on the inner side of a passenger vehicle door including a docking member for lockingly receiving a docking prong fixed to the wheelchair to permit lifting of the wheelchair to a position wherein it is securely carried on the door.

8 Claims, 8 Drawing Figures

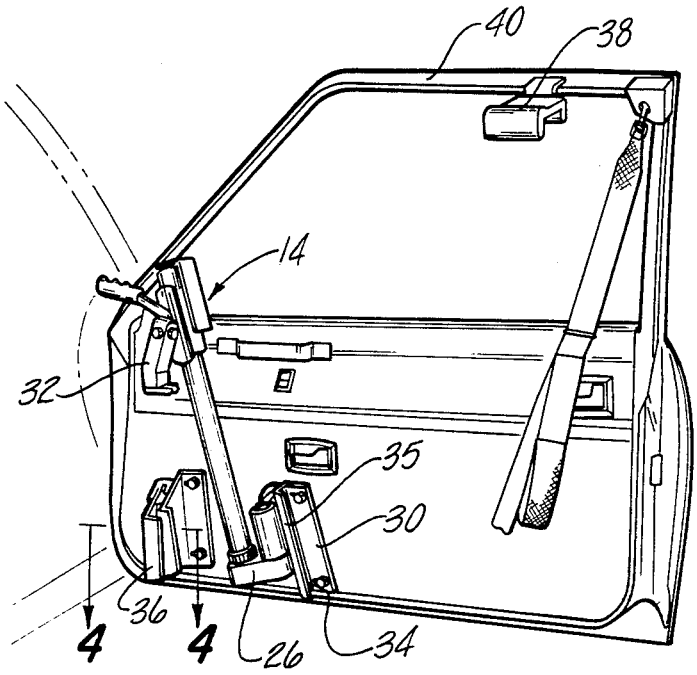
Fig-3
Fig-4
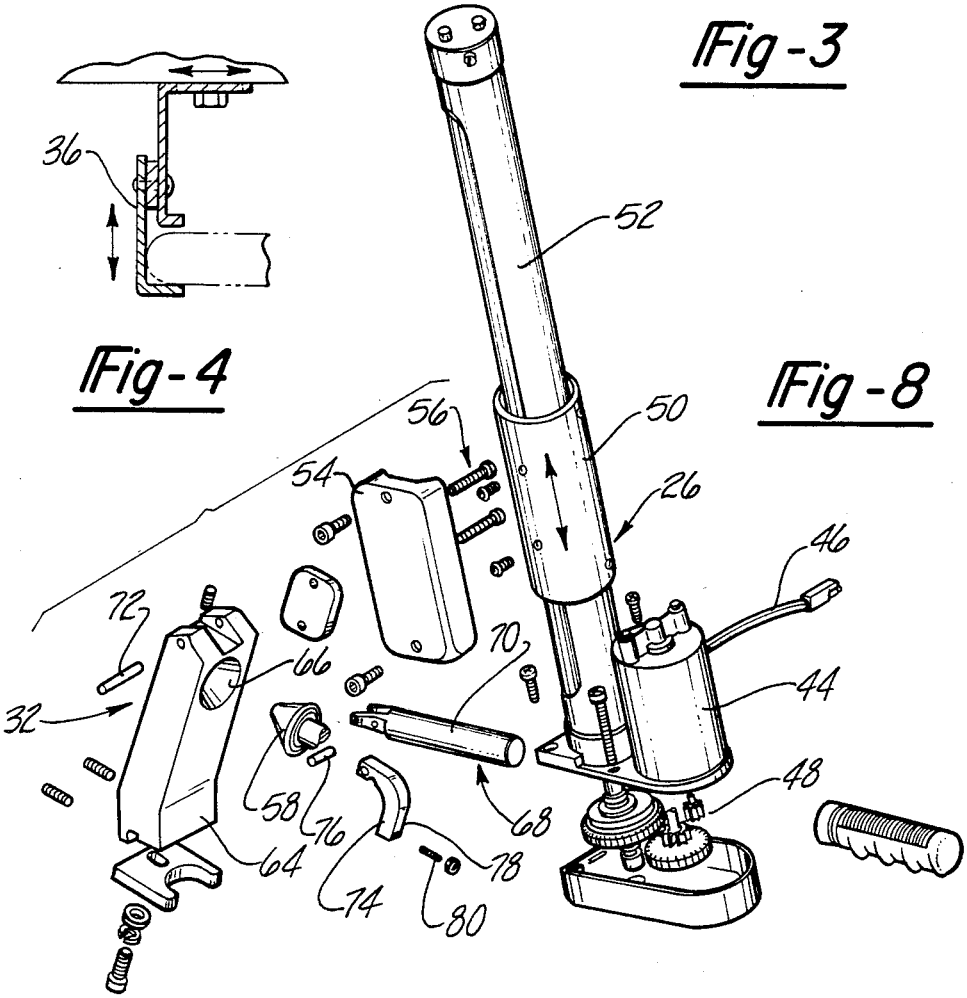
Fig-8

Fig-5
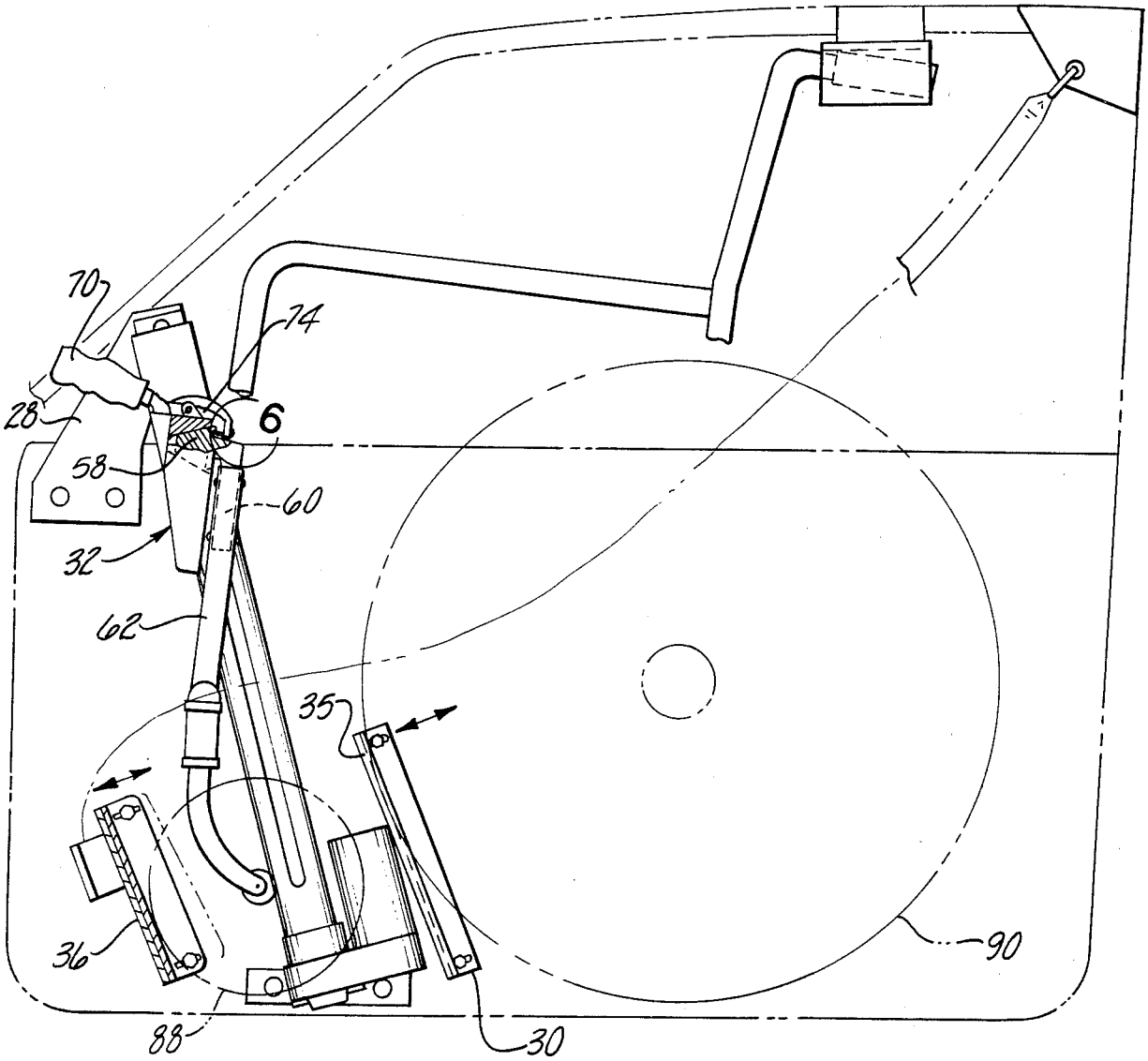
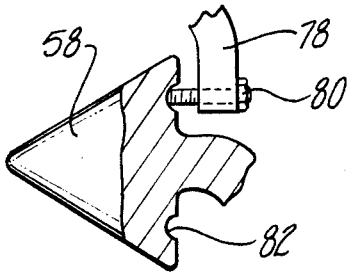
Fig-6
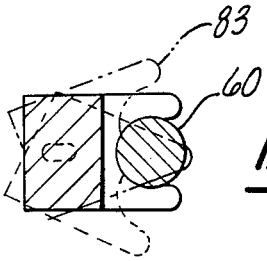
Fig-7

WHEELCHAIR ELEVATOR AND DOCKING SYSTEM

BACKGROUND OF THE INVENTION

Owing to the availability of hand controls for operating motor vehicles, many disabled persons who find it necessary to use wheelchairs for their transportation alternative to walking have acquired a certain degree of autonomy in vehicular transportation. One problem facing the disabled driver, however, in operating the passenger vehicle using hand controls is the handling of the driver's wheelchair in which the driver typically approaches the vehicle. Some of the same problems are faced, of course, by wheelchair users riding as passengers. One widely used system is that which utilizes conversion kits for large passenger vans. In such systems elevators are employed in which a wheelchair may be lifted from the ground to a level even with the floor of the van and the wheelchair then moved into the van and in some instances into the driver's position of the vehicle. Such systems suffer from certain major disadvantages in spite of the fact that they do provide the mobility intended for the disabled driver. These systems are extremely costly and add considerable weight to an already heavy vehicle, adversely affecting its fuel economy. In addition, such systems are conspicuous when viewed from the outside of the vehicle; and this is considered undesirable, particularly from a personal security standpoint.

Another "system" in common use is the use of two door passenger cars equipped merely with a hand control system for operating the vehicle. For certain highly autonomous disabled drivers, this system provides a nonconspicuous system providing vehicular mobility. Disadvantageously, however, it generally requires entry to and egress from the vehicle by the disabled driver through the driver side door on the "traffic" side of the vehicle and manual positioning of the wheelchair in the back seat of the vehicle by the disabled driver. Since it is well known that there are wide variances in the degree of disability encountered with drivers having the strength and dexterity necessary to operate a vehicle, it is clear that this latter system is not suitable for a wide range of disabled drivers, including those lacking the capability of personally stowing the wheelchair.

SUMMARY OF THE INVENTION

It is, accordingly, an object of the present invention to provide a wheelchair transportation system for facilitating the use of conventional passenger vehicles by disabled drivers and passengers, and accommodating the carrying of their wheelchairs with them during operation of the vehicle.

According to a feature of the invention, an elevator system is provided for lifting the wheelchair into a position adjacent the passenger door of the vehicle for stowage during operation of the vehicle.

According to a further feature of the invention, the elevator system includes a docking mechanism for attachment to the wheelchair which ensures that the desired lifting take place without damage to the wheelchair.

BRIEF DESCRIPTION OF THE DRAWINGS

These and other objects and features will become apparent upon reading the following specification with reference to the accompanying drawings, in which:

FIG. 3 is a perspective view of the elevator and docking mechanism of the present invention installed on the vehicle door;

FIG. 4 is a cross-sectional view taken along line 4—4 of FIG. 3;

FIG. 5 is a side diagrammatic view partially in section of a wheelchair docked with the docking mechanism of the present invention on the side door of the vehicle;

FIG. 6 is an enlarged, partially cross-sectional view of a portion of the docking mechanism of the present invention;

FIG. 7 is an enlarged, partially cross-sectional view of another portion of the docking mechanism of the present invention; and FIG. 8 is an exploded perspective view of the elevator and docking system of the present invention.

DESCRIPTION OF A PREFERRED EMBODIMENT

Figure 1:
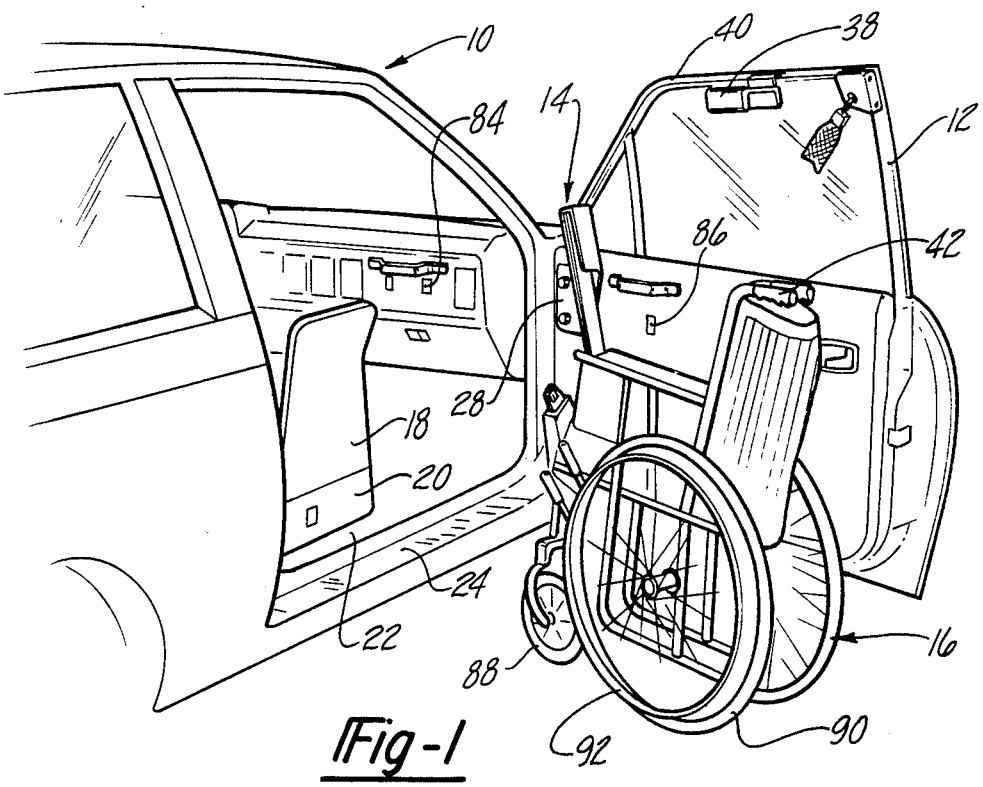
FIG. 1 is a rear perspective view of a passenger vehicle in which the invention wheelchair transporting system is installed showing the wheelchair positioned on the ground prior to lifting.
Figure 2:
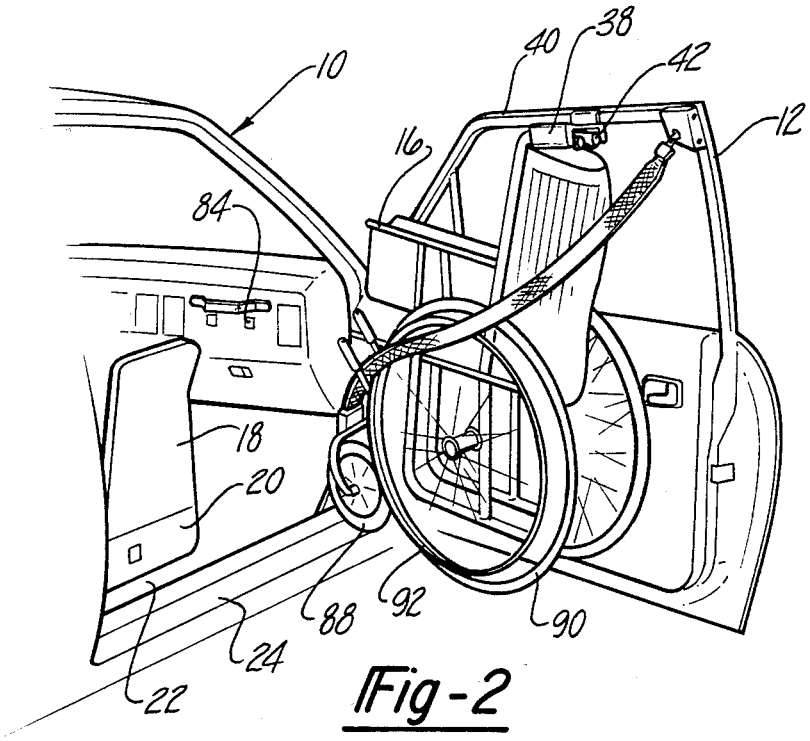
FIG. 2 is a rear perspective view similar to FIG. 1 showing the wheelchair in the lifted position.

Turning now to the drawings, in particular FIGS. 1 and 2 thereof, the system of the present invention whereby a wheelchair is transported with a passenger vehicle is pictorially illustrated. A motor vehicle 10 having a door 12 is illustrated as having an elevator and docking system indicated generally at 14 mounted on the door 12 for receiving a wheelchair 16 for storage against the door 12 and moving the wheelchair 16 from the ground position shown in FIG. 1 to an elevated position shown in FIG. 2.

The vehicle 10 is further shown as including a longitudinally hinged transfer bridge 18 attached to the passenger side edge of a vehicle seat (the remainder not shown) for permitting movement of the disabled driver from the wheelchair 16 to the interior of the vehicle 10. Strappings or the like may be employed to selectively retain the bridge 18 in the upright position shown. It will be noted that a gap 22, typically of approximately 10 to 12 inches, exists between the outer edge 20 of the vehicle seat and the door sill 24 providing increased stowage room for the folded conventional wheelchair 16 in the elevated position of FIG. 2 allowing closure of the door 12.

Turning next to FIG. 3, the elevator and docking system 14 is illustrated as it is installed on the inside of the door 12. It should be noted that the elevator system is positioned to provide angular travel of the wheelchair 16 as it moves upwardly from the road surface. This optimizes packaging of the wheelchair 16 in the cap 22 next to the seat of the vehicle 10 inside the door 12 and permits clearance of the wheelchair past the vehicle B-pillar. The elevator and docking system 14 is illustrated as consisting essentially of an elevator assembly 26 fixed to the inside of the vehicle door 12 through attachment plates 28 (FIG. 1) and 30, and a "dockingz38 *prong* receiver assembly 32 attached to a moving portion of the elevator assembly 26. In addition to the elevator assembly 26 and the docking prong receiver assembly 32, wheel (preferably right-hand) engaging ramps 34 and 36 are mounted on the inside of the door 12, the ramp 34 being preferably formed as an integral part of the elevator attachment plate 30 and including a wheelchair rear tire retaining lip 35. A handle retaining member 38 may also be provided at the upper edge 40 of the door 12 for receiving the handles 42 of the wheelchair 16 in the up (i.e., stowed and folded) position of the wheelchair illustrated in FIGS. 2 and 4.

The elevator assembly 26 may be of any known type providing linear movement along the path designated generally for the elevator assembly 26, but is illustrated in the preferred embodiment as best shown in FIG. 8 as consisting of an electric motor 44 connected as by wires 46 to a source of electric power (not shown) within the vehicle and mechanically connected to a gear train 48 through which power is transmitted to a linear actuator operative to move an element such as the sleeve indicated at 50 up and down the elevator column 52 positioned on the inner wall of the vehicle door 12. The docking prong receiver assembly 32 is carried for movement with the cylindrical sleeve 50 through a bracket 54 mounted by suitable fasteners such as indicated at 56 to the sleeve 50. The assembly cooperates with a prong 58 carried on a reinforcing rod member 60 which is inserted in a tubular frame member 62 of the wheelchair 16. The prong receiving assembly 32 includes a docking block 64 having a frusto-conical aperture 66 formed therein for receiving the docking prong 58 and a toggle operated retainer 68 mounted on the top of the docking block for capturing the prong 58 within the aperture 64. The toggle operated retainer 58 consists essentially of a handle 70 pivotally mounted as by a pin 72 to the docking block 64 and a hook member 74 pivotally mounted as through a pin 76 to the handle 70. Suitable engaging surfaces can be provided on the cooperating parts for effecting self-engaged and overcenter conditions between the hook 74 and the prong 58 to provide retention of the toggle mechanism in the closed position. In addition, fine adjustment of the position of the engaging surface of the locking end 78 of the hook member 74 can be effected through an adjustment screw such as indicated at 80 to engage an annular retaining groove 82 formed on the prong 58, as may best be seen in FIG. 6. The annular configuration of the groove 82 is effective to accommodate angular variations in the road surface or the like on which the wheelchair is placed during docking. Further, a tube receiving fork 83 is adjustably mounted as shown in FIG. 7 on the bottom of the block 64 for securely receiving and laterally retaining the tubular member 62 of the wheelchair 16.

OPERATION OF THE PREFERRED EMBODIMENT

The wheelchair transporting system of the present invention can be operated to securely lift and carry a wheelchair such as that depicted at 16 on the inside wall or trim panel of a door 12 of a vehicle 10 to position the wheelchair 16 in an unobtrusive manner on the passenger side of the vehicle.

The wheelchair-bound driver approaches the vehicle from the passenger side and opens the door 12 to the position shown in the drawing figure. The driver moves the wheelchair to a position in which the prong member 58 attached to the wheelchair 16 enters and seats in the aperture 66 of docking block 64. Actuation of the elevator assembly through the switch 86 to move the docking block in an aligning direction may also be accomplished, if necessary, because of the condition of the surface on which the wheelchair 16 rests. the driver then moves the handle 70 of the toggle mechanism 68 to the position shown in FIGS. 3 and 5, engaging the retaining surface 82 of the prong 58 preventing its inadvertent withdrawal. The driver may then transfer laterally into the vehicle 10 utilizing a mechanism such as the transfer bridge indicated at 18 and may then activate the elevator assembly on the dashboard of the vehicle 10. The alternate button 86 on the door 12 also allows such actuation. Slight movement of the elevator assembly 26 will first lift front and rear wheels 88, 90 of the wheelchair 16 from the ground and the wheelchair 16, which is preferably of known expanding scissors design, may be laterally folded as it is lifted to the configuration shown in FIGS. 1 and 2. During this initial movement and certain further movement of the elevator assembly 26, the weight of the wheelchair 16 is borne in cantilever fashion by the docking assembly 32. Reinforcement as indicated by the rod 60 may be employed. Upon further upward movement of the elevator assembly 18, however, the front wheels 88 engage the angle bracket 36 carried on the inside of the door 12 and the grab rim 92 as the rear wheel 90 engages the ramp surface 34 of the attaching bracket 30. This provides firm support for the wheelchair 16 and its tubular components during the lifting operation and during operation of the vehicle 10 with the wheelchair 16 stowed against the door 12, since the angular path of the ramps 34, 36 are chosen to coincide with the path of the elevator 18 during its lifting and lowering operations. Tolerancing, of course, suggests that one ramp may dominate in carrying the load. Sides of the ramps 34, 36 are tapered to provide centering during upward movement and with adjustment may be effective as indicated in FIG. 4 with respect to the front ramp plate 36.

While only one embodiment of the wheelchair transporting system in the present invention has been disclosed, those skilled in the mechanical handling arts will appreciate that others may be possible without departing from the scope of the appended claims. For example, attachment to the wheelchair 16 may be effected through and about tubular members other than that indicated at 62.

I claim:

1. A system for lifting a wheelchair from a position on the ground adjacent an automobile and retaining the wheelchair in place within the automobile, the automobile including a front door hinged for movement about its front face and the wheelchair being of the type having a foldable frame, a pair of large directionally fixed rear wheels and a pair of smaller front dirigible wheels, the system comprising an elevator mechanism carried on the inside of the door and positioned adjacent the door forward edge and having a linear actuator selectively movable along a generally vertical axis canted forwardly with respect to the door front face;

a docking member carried with the actuator and having a rearwardly facing frusto-conical aperture formed therein;

a means carried with a portion of the wheelchair frame and engageable with the docking member aperture; and locking means carried on the docking member for selectively locking the engageable means in the docking member for carrying the wheelchair in cantilever fashion for movement with the elevator actuator.

2. A system as defined in claim 1, wherein said engageable means comprises a frusto-conical docking prong.

3. A system as defined in claim 1, wherein said engageable means is secured to a tubular member of said wheelchair foldable frame to permit first holding movement of said wheelchair in response to initial upward movement of said elevator actuator and to effect elevation of said wheelchair upon further movement of said elevator.

4. A system as defined in claim 1, and further comprising ramp means defining upwardly and forwardly extending surfaces for supporting said wheelchair wheels in their elevated positions and during certain portions of their elevating movement.

5. A system as defined in claim 4, wherein said ramp means includes means defining a tapered channel for receiving portions of said wheelchair wheels for fixedly securing said wheels with respect to the vehicle door in the elevated position.

6. A system as defined in claim 1, wherein said locking means includes toggle operated locking portion for securing said engageable means to said docking member.

7. A system as defined in claim 1, and further comprising a receiver member positioned at the upper edge of said vehicle door for receiving handle portions of said wheelchair.

8. A system as defined in claim 1, wherein said linear actuator is driven by an electric motor.

* * * * *